US007189121B1

(12) United States Patent
Ko

(10) Patent No.: US 7,189,121 B1
(45) Date of Patent: Mar. 13, 2007

(54) PCB TYPE CONNECTOR

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/527,285

(22) Filed: Sep. 26, 2006

(51) Int. Cl.
*H01R 24/00* (2006.01)

(52) U.S. Cl. ..... 439/660; 439/328; 439/629

(58) Field of Classification Search ..... 439/59, 439/76.1, 607, 629, 660, 328, 579, 951
See application file for complete search history.

(56) References Cited

U.S. PATENT DOCUMENTS

| | | | | |
|---|---|---|---|---|
| 5,954,521 | A * | 9/1999 | Yang | 439/59 |
| 6,764,344 | B2 * | 7/2004 | Maiers | 439/629 |
| 7,101,188 | B1 * | 9/2006 | Summers et al. | 439/59 |
| 2006/0003639 | A1 * | 1/2006 | Ishizuka et al. | 439/660 |
| 2006/0030171 | A1 | 2/2006 | Huang | |
| 2006/0134969 | A1 * | 6/2006 | Takaku et al. | 439/495 |

* cited by examiner

*Primary Examiner*—Tho D. Ta
(74) *Attorney, Agent, or Firm*—Wei Te Chung

(57) ABSTRACT

A PCB type connector (10) includes a PCB (1), an insulative housing (2), a pair of latch members (3), and a metal shell (4). The PCB (1) includes a top surface and a bottom surface. The top surface has a row of golden fingers (11) locating at the front of the PCB (1), a pair of holes (12) being symmetrical along a central axial of the PCB (1) extending from the top surface to bottom surface, and two pairs of rectangle metal sheets (13) respectively locate at the two opposite sides of the holes (12) of the PCB (1). The insulative housing (2) comprises an elongate body portion (211) and two side portions (212) locating at two sides of the body portion (211). The body portion (211) has a pair of posts (21) extending along a vertical direction corresponding to the holes (12) and two pair of rectangle slots (25) corresponding to the rectangle metal sheet (13). The latch members (3) are locked to the two sides of the insulative housing (2). The metal shell (4) is assembled with the insulative housing (2). The insulative housing (2) locates between the PCB (1) and the metal shell (4), the PCB (4) extends beyond the forward edge of the insulative housing (2) and the metal shell (4), the golden finger (11) is exposed of the insulative housing (2) and the metal shell (4).

18 Claims, 4 Drawing Sheets

PCB TYPE CONNECTOR

BACKGROUND OF THE INVENTION

The present invention has referred to a Disclosure Document No. 603173 on Jul. 17 2006.

1. Field of the Invention

The present invention relates to a connector, and particularly to a PCB type connector.

2. Description of the Prior Art

Normally, Micro Coaxial Cable Connector (MCCA) is widely used to connect components arranged in a confined space inside an electronic device, such as a notebook computer, for deducing the overall size of the electronic device. A conventional MCCA connector assembly usually comprises an insualtive housing, a plurality of contacts received in the insualtive housing, and an Micro Coaxial Cable assembled to the insulative housing and electrically connecting with the contacts. However.

For Example, U.S. Pat. No. 6,273,753 B1 discloses a MCCA connector. Each Micro Coaxial Cable consists of a plurality of separated flat conductive members, each having an inner conductor, an inner insulative layer covering the inner conductor, an outer conductor, and an outer insulative layer covering the outer conductor. The inner conductor extending beyond the front ends of the insulative layers soldered to the contacts. However, during the inner conductor soldered to the contacts, WCCA is prone to being damaged, influencing reliable connection there between hard to be positioned and the electrical connection with the corresponding contacts is also hard to be perfect. And that, the process of the soldering waste work time.

Hence, an improved PCB type connector is desired to overcome the disadvantages of the prior art.

BRIEF SUMMARY OF THE INVENTION

Therefore, a main object of the present invention is to provide a PCB type connector, which can be easily and precisely assembled and is propitious to industrialization manufacture.

In order to implement the main object and overcome the above-identified deficiencies in the prior art, a PCB type connector comprises a PCB, an insulative housing, a latch, and a metal shell. The insulative housing is attached to the PCB through a pair of posts. The metal shell is assembled with the insulative housing. The latch is locked to the two sides of the insulative housing. The shell soldered to the PCB for assembled the PCB to the shell.

Other objects, advantages and novel features of the invention will become more apparent from the following detailed description when taken in conjunction with the accompanying drawings.

DETAILED DESCRIPTION OF THE PREFERRED EMBODIMENT

Figure 1:
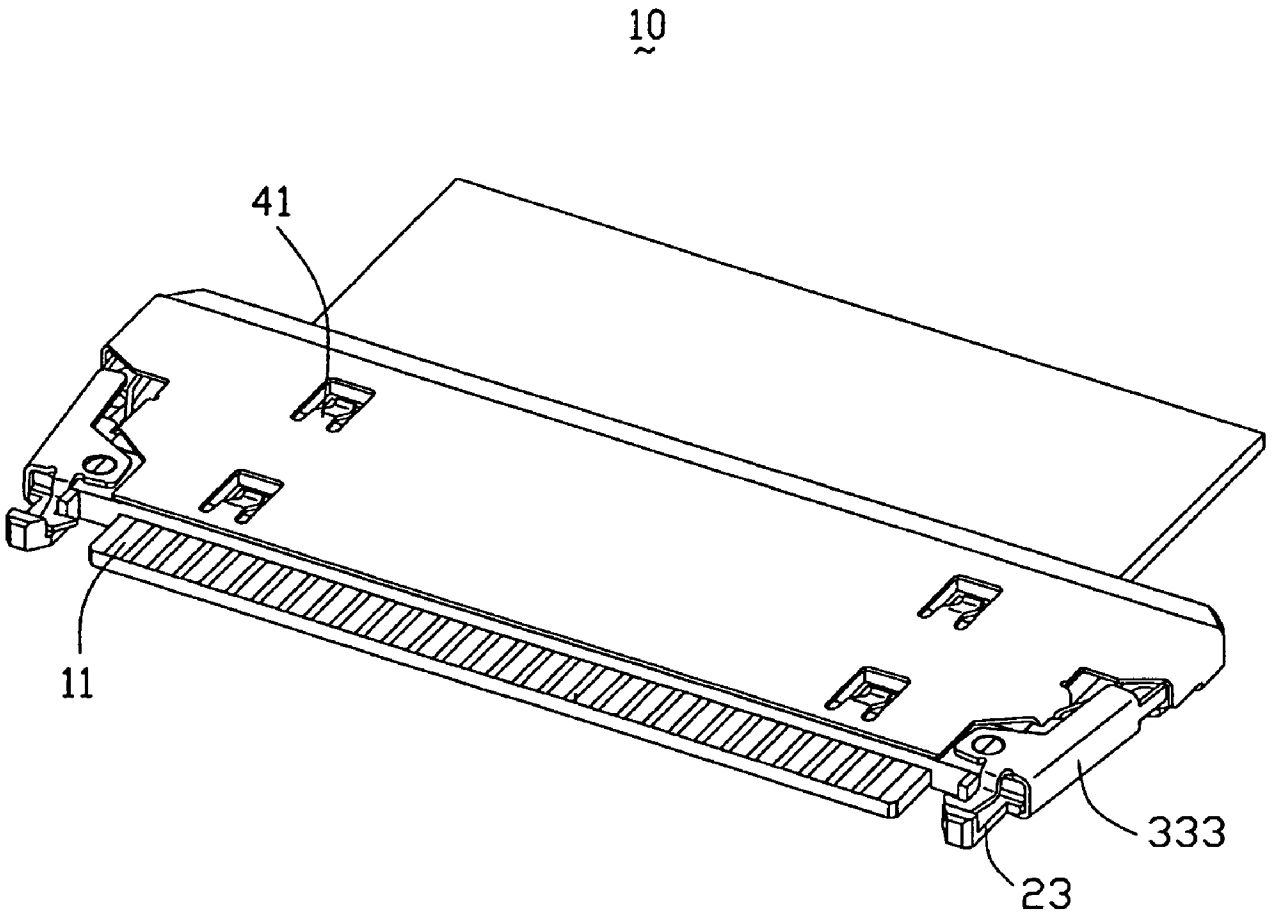
FIG. 1 is a perspective, assembled view of a PCB type connector according to the present invention.
Figure 2:
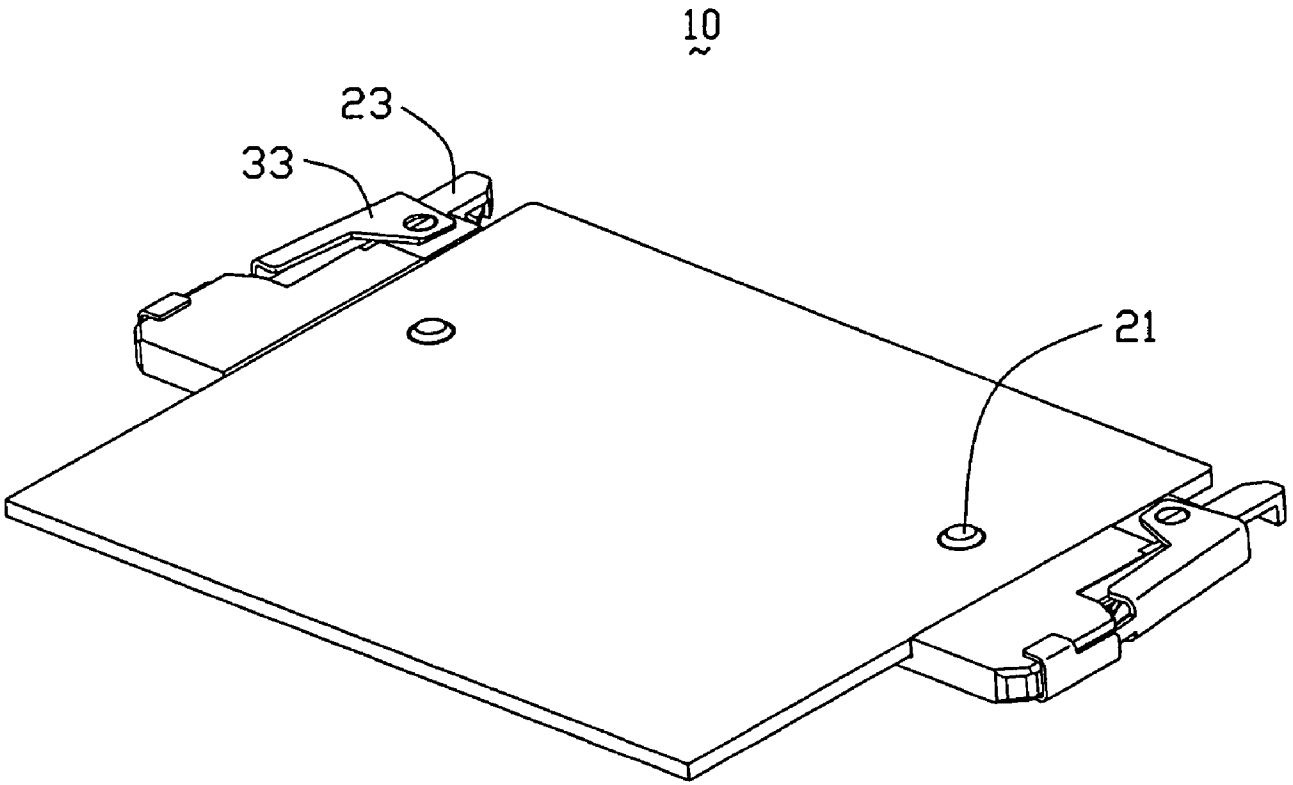
FIG. 2 is a view similar to FIG. 1, but viewed from a different aspect.
Figure 3:
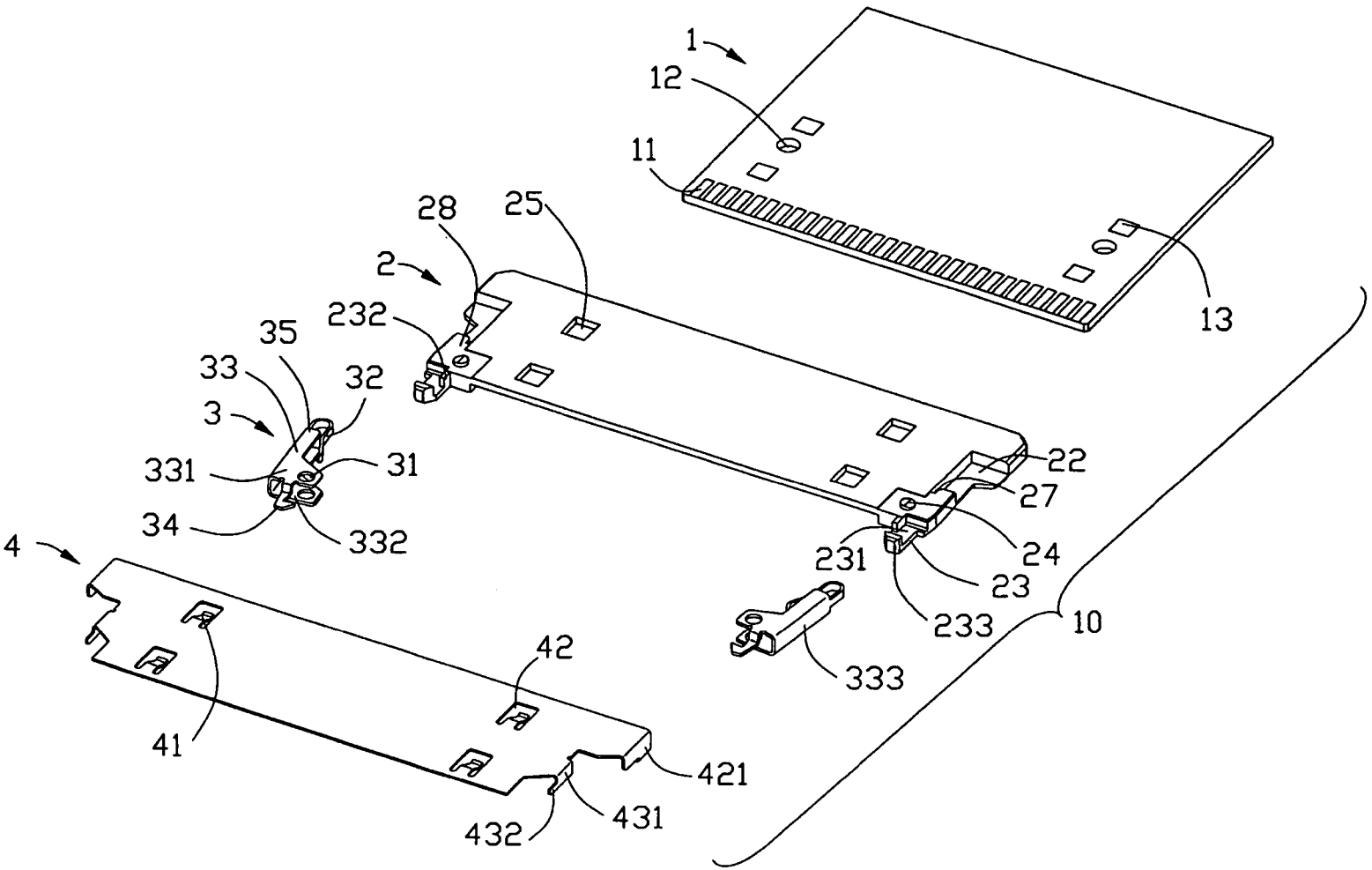
FIG. 3 is an exploded, perspective view of FIG. 1.

According to a exemplary embodiment of the present invention, shown in FIG. 3, a PCB type connector 10 comprises an insulative housing 2, a PCB 1 attached to the insulative housing 2, a pair of latch members 3 locked to the two sides of the insulative housing 2, a metal shell 4 assembled with the insulative housing 2, and a Micro Coaxial Cable (no show) solder at the end of the PCB 1. The PCB type connector 10 is adapted for electrically connecting with a complementary connector (not shown) due to its low profile, stable electrical properties and excellent preventing EMI (Electromagnetic Interference) function.

Figure 4:
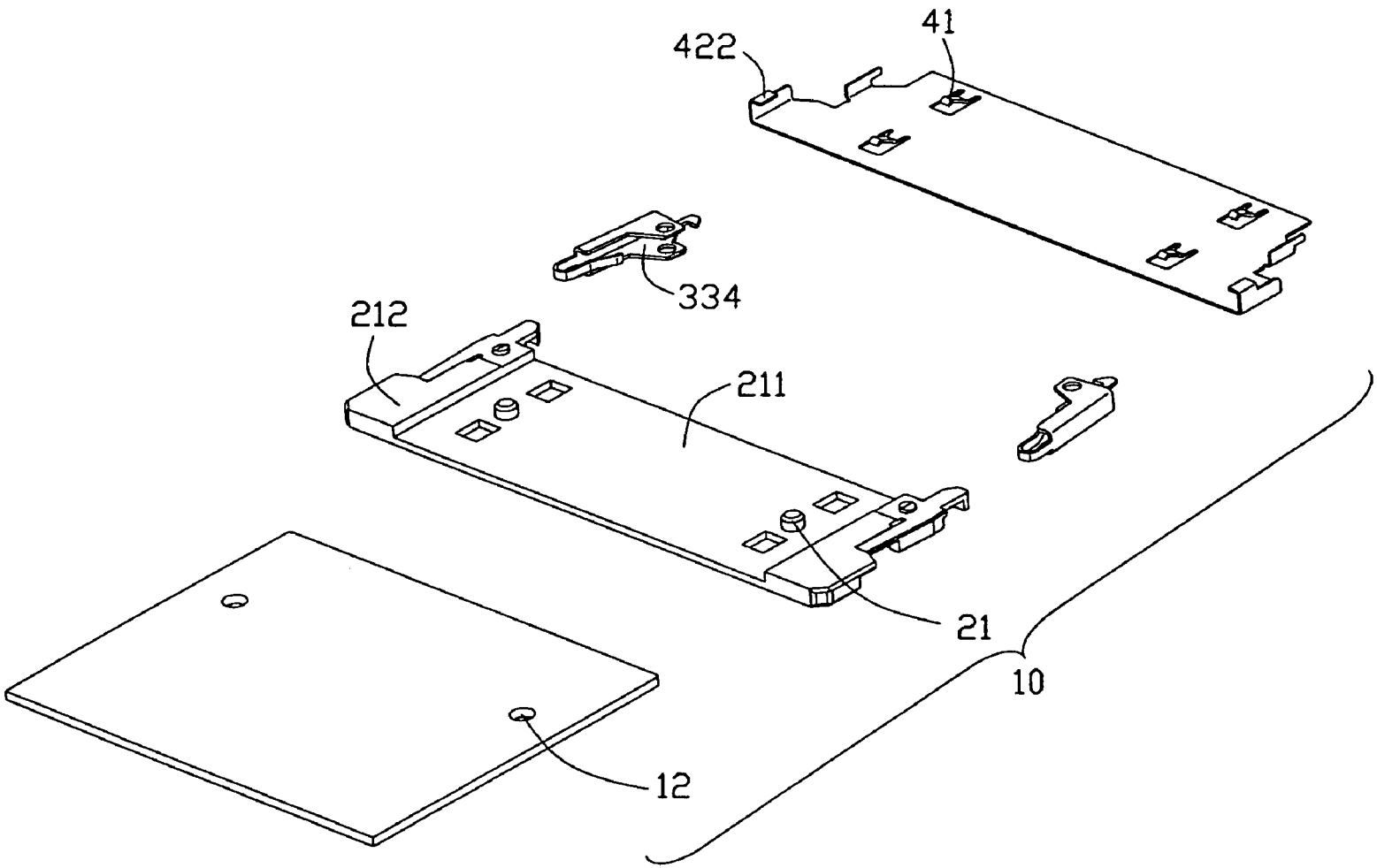
FIG. 4 is a view similar to FIG. 1, but viewed from a different aspect.

A structural description of the PCB type connector 10 will now be described with reference to FIGS. 3–4. The PCB 1 comprises a top surface and a bottom surface. A pair of circular holes 12 is symmetrically defined in the PCB 1 relative to a central axis of the PCB 1 extending from the top surface to bottom surface. The top surface has a row of golden fingers 11 locating at the front of the PCB 1. The forward edges of the golden fingers 11 are flush with the front face of the PCB 1. Two pairs of rectangle metal sheets 13 are formed on the top surface of the PCB and respectively locate at the two opposite sides of the hole 12 of the PCB 1 along front-to-back direction.

The insulative housing 2 has a first surface and a second surface, and comprises an elongate body portion 211, and two side portions 212 locating at two sides of the body portion 211. The body portion 211 has a pair of posts 21 depending downwardly from the second surface of the insulative housing 2 corresponding to the holes 12 of the PCB 1, and two pairs of rectangle slots 25 corresponding to the rectangle metal sheets 13. Each side portion 212 respectively has an L-shape cavity 22 for receiving the latch members 3, a pair of blocks 28 respectively having a slit 27 connecting to the L-shape cavity 22, and a pair of hooks 23 extending forwardly from the blocks 28. A pair of bolts 24 is defined at the top and bottom of each side portion 212 of the insulative housing 2. The pair of hooks 23 respectively have a receiving space 231, a protruding block 233 extending vertically from the forward end of the hook 23, and a space block 232 being defined at inner side of the receiving space 231.

The latch members 3 are respectively assembled to the side portions 212 of the housing 2 and each comprises a substantially L-shaped main body 33 and a hook portion 34 in a configuration of a claw extending forwardly from the main body 33. The main body 33 comprises a top portion 331, a bottom portion 332 opposite to the top portion 2611 and a side portion 333 connecting side edges of the top and bottom portions 331, 332. The top portion 331, the bottom portion 332, and the side portion 333 together define a receiving space 334. Each hook portion 34 extends through a corresponding cavity receiving space 231 of the housing 2. Two retention holes 31 are defined through the top and bottom portions 331, 332 of the main body 33. A pair of springs 32 respectively extends backwards from the main body 33.

The metal shell 4 comprises two pair of apertures 42 corresponding to the rectangle slots 25, a pair of first side tabs 421 extending downwardly from opposite lateral sides thereof, and a pair of second tabs 431 extending downwardly from opposite lateral sides thereof. Each aperture 42 defines a resilient finger 41 extending from a front side of the apertures 42 corresponding to the rectangle metal sheet 13.

Each first side tab 421 has a flange 422. Each second side tab 431 has a rib 432 extending forwardly.

Referring to FIGS. 1–4 together, the PCB 1, the insulative housing 2, the latch members 3, and the metal shell 4 are assembled to form the PCB type connector 10 as follows steps. Firstly, the insulative housing 2 is assembled to the PCB 1 with the posts 21 protruding through the holes 12 to position the PCB 1 and the insulative housing 2. The top surface of PCB 1 is attached to the second surface of the insulative housing 2. The forward edge of the PCB 1 is exposed out of the forward end of the insulative housing 2 for electrically connecting to the corresponding connector. Secondly, the latch members 3 is assembled on the insulative housing 2 with the retention holes 31 through the bolts 24 and capable of pivotally rotating relative to bolts 24. Thirdly, the metal shell 4 attaches to the first surface of the insulative housing 2 by moving the metal shell 4 forwardly, the rib 432 inserts into the corresponding slit 29 of block 28, and the flange 422 locks on the backside of the insulative housing 2. The resilient fingers 41 of the metal shell 4 are soldered to the rectangle metal sheets 13 of the PCB 1 after protruding through rectangle slots 25 of insulative housing 2 for enhancing the fastness. Of cause, the metal shell 4 also can attaches to the bottom surface of the PCB 1. The metal shell 4 also can comprises a top shell and a bottom shell, the top shell attaches to the insulative housing 2 and cover the first surface of the insulative housing, and the bottom shell attaches to the insulative housing 2 and cover the bottom surface of the PCB 1. The resilient fingers 41 through the slots 25 and contact the rectangle metal sheets 13 for grounding. The insulative housing 2 locates between the PCB 1 and the metal shell 4. The PCB 1 extends beyond the edge of the insulative housing 2 and the metal shell 4 and makes the golden fingers 11 being exposed.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A PCB type connector, comprising:

a PCB comprising a top surface and a bottom surface, the top surface has a row of golden fingers locating at the front of the PCB;

an insulative housing comprising a first surface and a second surface;

a pair of latch members locked to the two sides of the insulative housing; and a metal shell cover the first surface or second surface of the insulative housing and assembled to one of the insulative housing and the PCB; wherein the PCB extends beyond the forward edge of the insulative housing and the metal shell, the golden fingers are exposed out of the insulative housing and the metal shell;

wherein the bottom surface of the PCB is flush with the second surface of the insulative housing.

2. The PCB type connector as claimed in claim 1, wherein the metal shell cover the first surface of the insulative housing and assembled to the insulative housing, the insulative housing is located between the PCB and the metal shell.

3. The PCB type connector as claimed in claim 1, wherein the metal shell cover the first surface of the insulative housing.

4. The PCB type connector as claimed in claim 1, wherein the top surface of the PCB has a pair of holes extending from the top surface to bottom surface, the insulative housing has a pair of posts extending from the second surface corresponding to the pair of holes for positioning the PCB.

5. The PCB type connector as claimed in claim 1, wherein the PCB electrically connects the metal shell.

6. The PCB type connector as claimed in claim 1, wherein the insulative housing has at least a pair of rectangle slots, the PCB has at least a pair of rectangle metal sheets corresponding to the slots, the metal shell has at least a pair of fingers protruding through the slots and soldered to the rectangle metal sheets.

7. The PCB type connector as claimed in claim 1, wherein the metal shell comprises a pair of first side tabs extending downwardly from opposite lateral sides thereof, each first side tab has a flange locking on the backside of the insulative housing.

8. The PCB type connector as claimed in claim 1, wherein the insulative housing comprises an elongate body portion and two side portions locating at two sides of the body portion.

9. The PCB type connector as claimed in claim 8, wherein the two side portions of the insulative housing respectively have a L-shape cavity, the latch members has main body received in the L-shape cavity.

10. The PCB type connector as claimed in claim 9, wherein each side portion of the insulative housing has a pair of bolts respectively defined on the first surface and the second surface thereof, each latch member has a pair of retention holes respectively through the bolts.

11. The PCB type connector as claimed in claim 9, wherein each side portion of the insulative housing has a block having a slit connecting to the L-shape cavity, the metal shell comprises a pair of second tabs extending downwardly from opposite lateral sides thereof, each second side tab has a rib extending forwardly and inserting into the slit of the block.

12. A PCB type connector, comprising:

a PCB comprising a top surface and a bottom surface, the top surface has a row of golden fingers locating at the front of the PCB, at least one metal sheet and at least one hole;

an insulative housing comprising a first surface and a second surface forming at least one post extending along a vertical direction corresponding to the hole of the PCB; and a metal shell has at least one resilient finger; wherein the resilient finger soldered to the metal sheet, the PCB extends beyond the forward edge of the insulative housing and the metal shell, the golden fingers are exposed out of the insulative housing and the metal shell;

wherein the bottom surface of the PCB is flush with the second surface of the insulative housing.

13. The PCB type connector as claimed in claim 12, wherein the PCB type connector comprises a pair of latch members locked to the two sides of the insulative housing.

14. The PCB type connector as claimed in claim 12, wherein the top surface of the PCB has a pair of holes extending from the top surface to bottom surface, the insulative housing has a pair of posts extending from the second surface corresponding to the pair of holes for position the PCB.

15. The PCB type connector as claimed in claim 12, wherein the PCB electrically connect the metal shell.

16. An electrical connector comprising:

a printed circuit board defining two opposite faces and having a plurality of conductive traces disposed upon a front edge area of one of said faces to provide a mating port for mating with a complementary connector;

an insulative housing defining two opposite exterior surfaces and assembled to a front portion of one of said faces of the printed circuit board and equipped with latches for latched to said complementary connector;

a metallic shell assembled to the housing opposite to said printed circuit board; wherein one of said exterior surfaces of the housing is flush with the other of the faces of printed circuit board while the other of said exterior surfaces of the housing is vertically offset from said one of the faces of the printed circuit board.

17. The electrical connector as claimed in claim 16, wherein the conductive traces and the housing are located on said two opposite faces, respectively.

18. The electrical connector as claimed in claim 16, wherein said printed circuit board is rigid enough to support itself.

* * * * *